US009233883B1

(12) United States Patent
Rauscher et al.

(10) Patent No.: US 9,233,883 B1
(45) Date of Patent: Jan. 12, 2016

(54) POLYMER COMPOSITE COMPRISING METAL BASED NANOPARTICLES IN A POLYMER MATRIX

(71) Applicant: Cornerstone Research Group, Inc., Dayton, OH (US)

(72) Inventors: Michael D. Rauscher, Beavercreek, OH (US); Emily A. Frake, Kettering, OH (US); Michael J. Fisher, Springboro, OH (US); Brian E. Henslee, Galloway, OH (US)

(73) Assignee: Cornerstone Research Group, Inc., Dayton, OH (US)

( * ) Notice: Subject to any disclaimer, the term of this patent is extended or adjusted under 35 U.S.C. 154(b) by 80 days.

(21) Appl. No.: 14/189,301

(22) Filed: Feb. 25, 2014

Related U.S. Application Data

(60) Provisional application No. 61/789,186, filed on Mar. 15, 2013.

(51) Int. Cl.

| | |
|---|---|
| ***C06B 45/00*** | (2006.01) |
| ***C06B 45/30*** | (2006.01) |
| ***D03D 23/00*** | (2006.01) |
| ***D03D 43/00*** | (2006.01) |
| ***C06B 23/00*** | (2006.01) |
| ***C06B 33/00*** | (2006.01) |

(52) U.S. Cl.
CPC ..... *C06B 45/30* (2013.01); *C06B 23/005* (2013.01); *C06B 33/00* (2013.01)

(58) Field of Classification Search
USPC ..... 149/2, 5, 109.6
See application file for complete search history.

(56) References Cited

U.S. PATENT DOCUMENTS

| | | | |
|---|---|---|---|
| 3,155,749 | A | 11/1964 | Rossen et al. |
| 3,309,249 | A | 3/1967 | Allen |
| 3,322,515 | A | 5/1967 | Dittrich et al. |
| 3,995,559 | A | 12/1976 | Bice et al. |
| 4,923,535 | A | 5/1990 | Waters et al. |
| 5,606,146 | A | 2/1997 | Danen et al. |
| 5,703,173 | A | 12/1997 | Koloski et al. |
| 5,977,241 | A | 11/1999 | Koloski et al. |
| 6,232,386 | B1 | 5/2001 | Vargo et al. |
| 6,548,590 | B1 | 4/2003 | Koloski et al. |
| 6,562,159 | B2 | 5/2003 | Ampleman et al. |
| 6,608,129 | B1 | 8/2003 | Koloski et al. |
| 7,217,754 | B2 | 5/2007 | Koloski et al. |
| 7,223,312 | B2 | 5/2007 | Vargo et al. |

(Continued)

OTHER PUBLICATIONS

F. Delogu; Numerical simulation of the thermal response of Al core/Ni shell nanometer-sized particles; Nanotechnology; Oct. 21, 2007; pp. 1-7; 2007 IOP Publishing Ltd.

(Continued)

*Primary Examiner* — James McDonough
(74) *Attorney, Agent, or Firm* — Dinsmore & Shohl LLP

(57) ABSTRACT

A composite having a substrate and a plurality of core-shell nanoparticles. The substrate has microporosity, nanoporosity, or free volume and is a polymer matrix, a metal-organic framework, a micro-porous structure, or a nano-porous structure. The plurality of core-shell nanoparticles each has a core and at least one shell layer. The core is made from a decomposed product of a first precursor disposed in the microporosity, nanoporosity, or free volume of the substrate. The at least one shell layer is made from a decomposed product of a second precursor and is disposed on the core.

9 Claims, 3 Drawing Sheets

(56) References Cited

U.S. PATENT DOCUMENTS

| | | | | |
|---|---|---|---|---|
| 7,635,461 | B2 * | 12/2009 | Anderson | B01J 23/02 423/579 |
| 7,927,437 | B2 * | 4/2011 | Gangopadhyay | C06B 33/00 149/108.2 |
| 8,066,831 | B2 * | 11/2011 | Gangopadhyay | C06B 45/14 149/109.2 |
| 8,177,878 | B2 | 5/2012 | Heinrich et al. | |
| 8,257,523 | B1 * | 9/2012 | Puszynski | C06B 21/0008 149/108.2 |
| 2004/0019143 | A1 | 1/2004 | Koloski et al. | |
| 2010/0032064 | A1 * | 2/2010 | Dreizin | C06B 21/0066 149/37 |
| 2010/0279102 | A1 | 11/2010 | Gangopadhyay et al. | |
| 2011/0127314 | A1 * | 6/2011 | Heinrich | B23K 1/0006 228/123.1 |
| 2012/0132644 | A1 | 5/2012 | Gu et al. | |
| 2014/0227548 | A1 * | 8/2014 | Myrick | C06B 45/30 428/570 |

OTHER PUBLICATIONS

Alexander V. Evteev, Elena V. Levchenko, Daniel P. Riley, Irina V. Belova, Graeme E. Murch; Reaction of a Ni-coated Al nanoparticle to form B2-NiAl: A molecular dynamics study; Philosophical Magazine Letters; vol. 89, No. 12; Dec. 2009; pp. 815-830.

Elena V. Levchenko; Alexander V. Evteev; Daniel P. Riley; Irina V. Belova, Graeme E. Murch; Molecular dynamics simulation of the alloying reaction in Al-coated Ni nanoparticle; Elsevier ScienceDirect, Computational Materials Science 47 (2010); pp. 712-720.

Ngoc Ha Nguyen; Anming Hu, John Persic, John Z. Wen; Molecular dynamics simulation of energetic aluminum/palladium core-shell nanoparticles; Elsevier ScienceDirect, Chemical Physics Letters 503 (2011) pp. 112-117.

Pengxiang Song, Dongheng Wen; Molecular Dynamics Simulation of a Core-Shell Structured Metallic Nanoparticle; J. Phys. Chem. C 2010, 114, pp. 8688-8696.

K.T. Sullivan, N.W. Piekiel, S. Chowdhury, C. Wu, M.R. Zachariah, C.E. Johnson; Ignition and Combustion Characteristics of Nanoscale Al/AgIO3; A Potential Energetic Biocidal System; Combust. Sci. And Tech., 183 (2011), pp. 285-302.

K.T. Sullivan, W. W. Piekiel, C. Wu, S. Chowdhury, S.T. Kelly, T.C. Hufnagel, K. Fezzaa, M.R. Zachariah; Elsevier ScienceDirect; Combustion and Flame 159 (2012); pp. 2-15.

A. Prakash, a.V. Mccormick, M.R. Zachariah; Tuning the Reactivity of Energentic Nanoparticles by Creation of a Core-Shell Nanostructure; Nano Letters, 2005, vol. 5, No. 7, pp. 1357-1360.

Davin G. Piercey, Thomas M. Klapotke; Nanoscale Aluminum—Metal Oxide (Thermite) Reactions for Application in Energetic Materials; Central European Journal of Energetic Materials; 2010; 2(2), pp. 115-129.

* cited by examiner

POLYMER COMPOSITE COMPRISING METAL BASED NANOPARTICLES IN A POLYMER MATRIX

CROSS-REFERENCE TO RELATED APPLICATIONS

This application claims the benefit of U.S. Provisional Application No. 61/789,186, filed Mar. 15, 2013.

STATEMENT REGARDING FEDERALLY SPONSORED RESEARCH OR DEVELOPMENT

This invention was made with U.S. Government support under Contract No. W15QKN-10-C-0028, W15QKN-11-C-0024, W15QKN-11-C-0184 and W15QKN-11-C-0176 awarded by the United States Army Armament Research, Development, and Engineering Center and Contract No. W15P7T-12-C-5003 awarded by the United States Army Research, Development, and Engineering Command to Cornerstone Research Group Inc. The U.S. Government has certain rights in the invention.

BACKGROUND

The present disclosure relates to composite materials having a substrate and a plurality of core-shell nanoparticles disposed therein.

Current methods for producing inorganic metal or metal-oxide nanoparticles encounter difficulties. These challenges include nanoparticle agglomeration, uneven nanoparticle dispersion, nanoparticle size limitations, complicated multi-step processes to form nanoparticles, complicated multi-step processes to form nanocomposites, free nanoparticle safety hazards, inability to scale-up production, and an inability to form complex multi-domain, multi-material nanoparticles.

BRIEF SUMMARY

According to the subject matter of the present disclosure, a composite comprising core-shell nanoparticles in a substrate having microporosity, nanoporosity, or free volume is provided. The core-shell nanoparticles comprise multiple layers. A method of producing the composite is also provided.

In accordance with one embodiment of the present disclosure, a composite is provided. The composite includes a substrate having microporosity, nanoporosity, or free volume. The substrate is a polymer matrix, a metal-organic framework, a microporous structure, or a nanoporous structure. The composite further include a plurality of core-shell nanoparticles. The core-shell nanoparticles have a core made from a decomposed product of a first precursor disposed in the microporosity, nanoporosity, or free volume of the substrate; and at least one shell layer made from a decomposed product of a second precursor disposed on the core or a shell layer of the first precursor. The decomposed product of the first precursor is different from the decomposed product of the second precursor.

In accordance with another embodiment of the present disclosure, a composite is provided. The composite includes a substrate having microporosity, nanoporosity, or free volume, wherein the substrate is a polymer matrix, a metal-organic framework, a microporous structure, or a nanoporous structure. The composite further includes a plurality of core-shell nanoparticles substantially free from agglomeration. The core-shell nanoparticles have a core made from a decomposed product of a first precursor disposed in the microporosity, nanoporosity, or free volume of the substrate and at least one shell layer made from a decomposed product of a second precursor formed on the core. The core is a metal and the at least one shell layer is a metal oxide or the core is the metal oxide and the at least one shell is the metal.

In accordance with still another embodiment of the present disclosure, a method of forming a composite is provided. The method includes combining a first precursor and a substrate via at least one of diffusion, absorption, and adsorption. The method further includes forming a nanoparticle core through decomposition of the first precursor and nucleation of the decomposition product of the first precursor. The method also includes forming a shell layer of at least a second material through adsorption of at least a second precursor followed by decomposition, and nucleation of at least one shell layer on the nanoparticle core to form a core-shell nanoparticle in the substrate. The substrate has at least one of microporosity, nanoporosity, or free volume, and the first precursor and the second precursor are decomposed in-situ to form the nanoparticle core and shell layers.

BRIEF DESCRIPTION OF THE SEVERAL VIEWS OF THE DRAWINGS

The following detailed description of specific embodiments of the present disclosure can be best understood when read in conjunction with the following drawings, where like structure is indicated with like reference numerals and in which.

DETAILED DESCRIPTION

Figure 1:
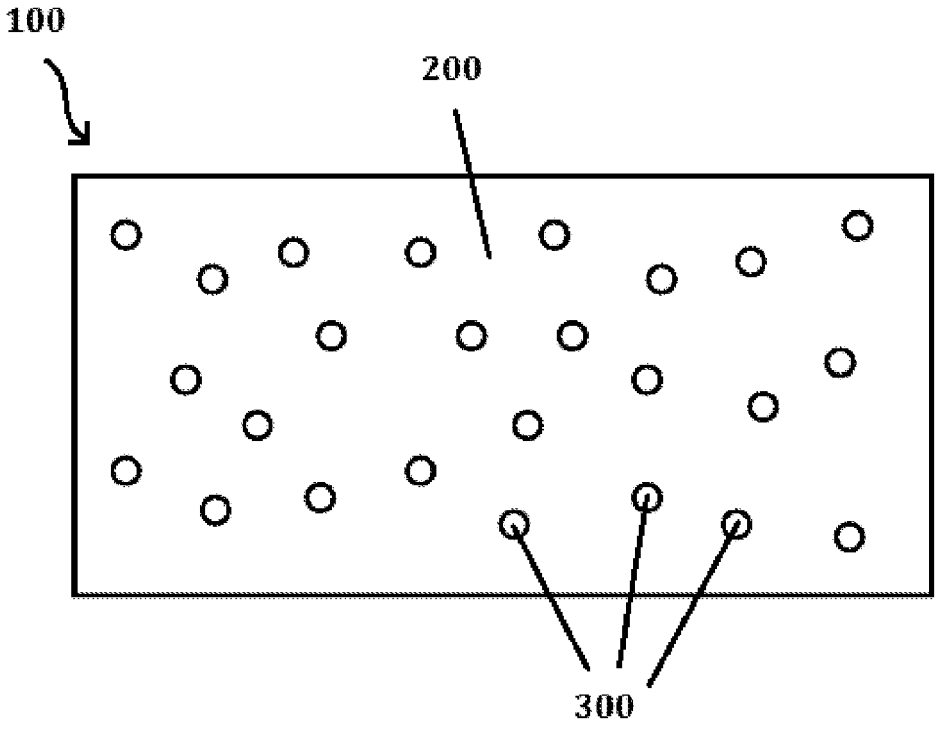
FIG. 1 is a schematic illustration of a composite according to one embodiment of the present disclosure.
Figure 2:
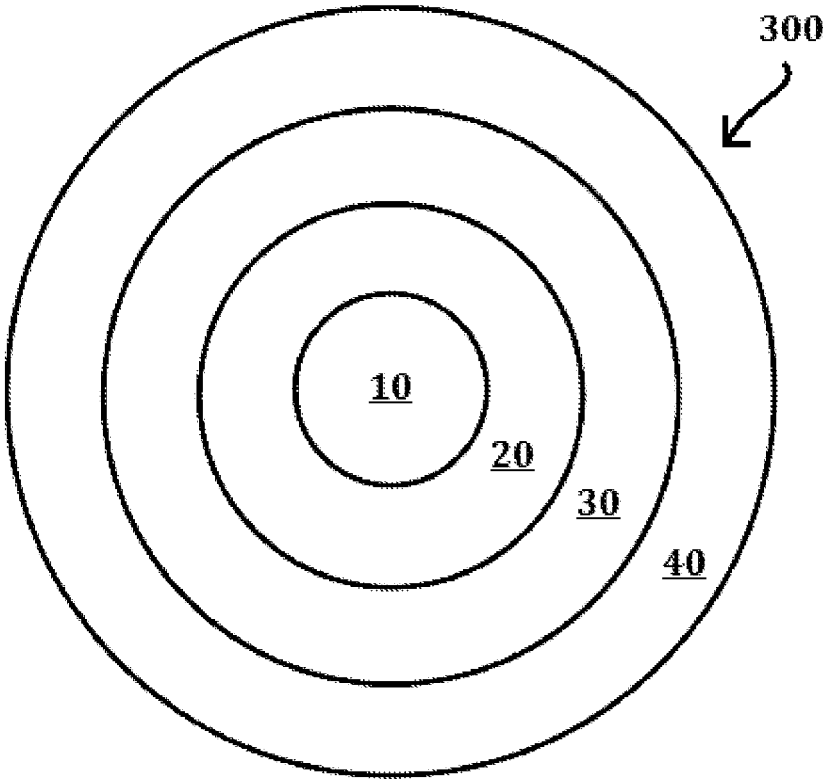
FIG. 2 is a schematic illustration of a core-shell nanoparticle according to another embodiment of the present disclosure.

Referring to the drawings in general and to FIG. 1 and FIG. 2 in particular, it will be understood that the illustrations are for the purpose of describing a particular embodiment of the invention and are not intended to limit the invention thereto. A composite 100 comprises a substrate 200 having and a plurality of core-shell nanoparticles 300. The substrate 200 is a polymer matrix, a metal-organic framework, a microporous structure, or a nanoporous structure. Microporosity and nanoporosity are used to describe the presence of vacant space within the matrix of a porous substrate. The linear dimensions of such space are in the order of about 0.5 μm to about 500 μm for microporous substrate, and about 0.5 nm to about 500 nm for nanoporous substrate, respectively. Free volume is used to describe the vacant sites within a polymer substrate into which organic or inorganic molecules can diffuse within the substrate. The linear dimensions of such space are in the order of about 0.04 nm to about 0.5 nm. The core-shell nanoparticles 300 comprise a core 10 comprising a decomposed product of a first precursor disposed in the microporosity, nanoporosity, or free volume of the substrate 200 and at least one shell layer 20, 30, 40 comprising a decomposed product of a second precursor disposed on the core 10 or a shell layer 20, 30, 40 of the decomposed product of the first precursor. Thus, the core 10 may be built up with shell layers 20, 30, 40 of the decomposed product of the first precursor before at least one shell layer 20, 30, 40 of the decomposed product of the second precursor is added. For purposes of this disclosure, the decomposed product of the first precursor, the decomposed product of the second precursor, and the decomposed product of further precursors are considered to be the decomposition products deposited in the substrate and/or on the core-shell nanoparticles 300 and not a gaseous species released in the decomposition process.

In situ nanomanufacturing technology is a method to form and grow nanoparticles directly inside a host polymer substrate 200. The general process involves absorbing a nanoparticle precursor material into the host polymer substrate 200. Following absorption, the precursor is subsequently decomposed while in the host polymer substrate 200 (in situ) to form a core 10. The precursor absorption and decomposition steps can be repeated one or multiple times as desired resulting in an additional shell layer 20, 30, 40 to the initial core 10 each time, thereby resulting in the formation of core-shell nanoparticles 300.

In situ nanomanufacturing is capable of forming core-shell nanoparticles 300 of single or multiple elemental compositions in the shell layers 20, 30, 40 by growing the core-shell nanoparticles 300 in a layer by layer fashion. To grow the size of core-shell nanoparticles 300 while keeping the same elemental composition throughout the shell layers 20, 30, 40, the absorption and decomposition processes are repeated with the same precursor for all the shell layers 20, 30, 40 such that the first precursor is used to form the initial core 10 and the second precursor is used to form the shell layers 20, 30, 40. To form a core-shell nanoparticle 300 with different elemental composition between shell layers 20, 30, 40, the absorption and decomposition processes are repeated with a different precursor for different shell layers 20, 30, 40. For example, the core 10 and a subset of the shell layers 20, 30, 40 are formed from the first precursor and the remaining subset of the shell layers 20, 30, 40 are formed from at least the second precursor with a third precursor, a fourth precursor, and additional precursors imagined. Additionally, different core 10 or shell layer 20, 30, 40 compositions can be obtained from the same precursor by using different decomposition processes. Thus, in an embodiment, all or a subset of the first precursor, the second, precursor, the third precursor, the fourth precursor, and additional imagined precursors may be the same yet yield distinct deposited decomposition products by using different decomposition processes. The deposited decomposition products may be different, for example, in terms of chemical compositions, in terms of morphologies, or in terms of crystalline phase structures. The different layers in the core-shell nanoparticle 300 structure can be metals, metal-oxides, or polymers. This multi-element layer-by-layer capability allows ultimate flexibility in producing a broad range of core-shell nanoparticle 300 structures. The process has the ability to switch materials between layers with almost no restrictions in the possible number of layers. Therefore, the possible combinations of core-shell nanoparticle 300 architectures are numerous.

The substrate 200 has microporosity, nanoporosity, or free volume to form core-shell nanoparticles 300 therein. The substrate 200 is comprised of a polymer matrix, a metal-organic framework, a microporous structure, or a nanoporous structure. In various embodiments the substrate 200 is a liquid or a solid depending on the particular application. Non-limiting examples of the substrate 200 include monomers, homopolymers, copolymers, or combinations of polyimides, polyamides, polyalkylenes (such as polyethylene and polypropylene), polycaprolactone, modified cellulose derivatives, starch, polyesters, polymethacrylates, polyacrylates, polyvinyl alcohol, polyvinyl acetate, polyvinylpyrrolidone, polyacrylamide, poly(alkylene oxides), poly(vinyl chloride), polybutadiene, polysiloxanes, and fluoropolymers (such as polyfluoroalkylenes, poly(fluoroalkyl vinyl ethers), fluorochloropolymers and perfluoropolymers), epoxy and polyurethanes.

Referring to FIG. 2, an embodiment of a core-shell nanoparticle 300 is shown. The initial core 10 nanoparticle created by absorption and decomposition of a first precursor is represented by the center of FIG. 2. Subsequent absorption and decomposition processes produce a first shell 20, a second shell 30, a third shell 40, and as many additional shell layers 20, 30, 40 as desired for a particular application. In an embodiment, the elemental compositions of the core 10, the first shell 20, the second shell 30, the third shell 40, and additionally potential shell layers can be metal or metal oxides. In another embodiment, the compositions of the core 10, the first shell 20, the second shell 30, the third shell 40, and additionally potential shell layers can be polymers. In yet another embodiment, the compositions of the core 10, the first shell 20, the second shell 30, the third shell 40, and additionally potential shell layers can be a combination of polymers, metals, and metal oxides. The addition of shell layers 20, 30, 40 enables the growth in size of the core 10 and the overall core-shell nanoparticle 300.

Figure 3:
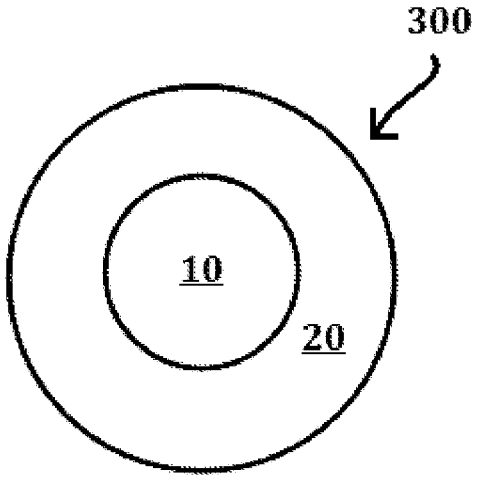
FIG. 3 is a schematic illustration of a core-shell nanoparticle according to another embodiment of the present disclosure.

The layer arrangement of core-shell nanoparticles 300 may be diverse among the various embodiments. In an embodiment, the core-shell nanoparticles 300 comprise "n" repeating iterations of layers of the decomposed products of the first precursor and the second precursor, wherein "n" is at least 1 and the deposited products resulting from the decomposition of first precursor and the second precursor are distinct. In accordance with FIG. 2 for "n" equals 2, the core 10 and second shell 30 are formed from the first precursor and the first shell 20 and the third shell 40 are formed from the second precursor. Additionally, in accordance with FIG. 3 for "n" equals 1, the core 10 and is formed from the first precursor and the first shell 20 is formed from the second precursor. In various further embodiments, "n" is 3, 4, 5, or 50 for example.

In a further embodiment, the core-shell nanoparticles 300 comprise a shell layer 20, 30, 40 of at least the decomposed product of a third precursor formed on the decomposed product of the first precursor or second precursor. For example, in accordance with FIG. 2, the core 10 is formed from the first precursor, the first shell 20 is formed from the second precursor, and the second shell 30 is formed from the third precursor. An alternative arrangement in accordance with FIG. 2 is the core 10 is formed from the first precursor, the first shell 20 is formed from the second precursor, the second shell 30 is formed from the first precursor, and the third shell 40 is formed from the third precursor. In a further embodiment, the core-shell nanoparticles 300 comprise "k" repeating iterations of layering of the decomposed product of the first precursor, the second precursor, and the third precursor, wherein "k" is at least 1. For example, in accordance with FIG. 2, the core 10 is formed from the first precursor, the first shell 20 is formed from the second precursor, the second shell 30 is formed from the third precursor, the third shell 40 is formed from the first precursor, and subsequent shell layers are formed from the second precursor and the third precursor. In various further embodiments, "k" is 2, 3, 4, or 5 for example.

In yet another embodiment, the core-shell nanoparticles 300 comprise "j" repeating iterations of layer of the decomposed products of the second precursor and the third precursor on the decomposed product of the first precursor, wherein "j" is at least 2. For example, in accordance with FIG. 2, the core 10 is formed from the first precursor, the first shell 20 is formed from the second precursor, the second shell 30 is formed from the third precursor, the third shell 40 is formed again from the second precursor, and the next shell layer is formed from the third precursor. In various further embodiments, "j" is 3, 4, 5, or 50 for example.

In an embodiment, the core-shell nanoparticles 300 are substantially free from agglomeration. For purposes of this disclosure "substantially free from agglomeration" means that less than 20% of the core-shell nanoparticles 300 form clusters of more than 4 particles.

In a further embodiment, the shell layers 20, 30, 40 form an uninterrupted coating over the core 10. An uninterrupted coating over the core 10 prevents exposure of the core 10 to external elements. Additionally, an uninterrupted coating as the first shell 20 over the core 10 allows the core 10 and the second shell 30 to be separated by a barrier layer of the first shell 20. This may be desirable when reactive species are used as different shell layers 20, 30, 40 or core 10 of the core-shell nanoparticle 300.

In situ nanomanufacturing of core-shell nanoparticles 300 in a substrate 200 provides some additional beneficial properties in the resulting nanocomposite 100. For example, non-agglomerated core-shell nanoparticles 300 form in the resulting nanocomposite 100 and are dispersed throughout the substrate 200. In an embodiment, the nanoparticles 300 are uniformly dispersed. Typically, the loadings of the nanoparticles 300 within the substrate 200 are less than approximately 20 wt % of the total nanocomposite 100. In further embodiments, loadings of less than approximately 5 wt %, 10 wt %, and 15 wt % are imagined. The uniform dispersion of such core-shell nanoparticles 300 allows close proximity and interactions between the core-shell nanoparticles 300 and the substrate 200 matrix material. Additionally, the core-shell nanoparticles 300 maintain a uniformity in size between the core-shell nanoparticles 300, as they each form in the same manner. The ability to form the core-shell structures as well as the ability to control the size of the resulting core-shell nanoparticles 300 as a result of the layer-by-layer processing is also beneficial for enabling tunability of material properties. Finally, forming the core-shell nanoparticles 300 in situ in the substrate 200 eliminates the health hazards resulting from free nanoparticle powders as the resulting core-shell nanoparticles 300 are trapped in the substrate 200.

The first precursor, the second precursor, and additional precursors preferably have sufficient mobility to absorb into the substrate 200. In various embodiments the mobility of the precursors into the substrate 200 can be accomplished via the interaction of: a solid polymer substrate 200 and a liquid precursor; a solid polymer substrate 200 and a gaseous precursor, although other combinations are possible.

In various embodiments the precursors include, but are not limited to, metal-organic compounds. These materials are commonly employed in chemical vapor deposition systems. The metal-organic compounds generally comprise the metal species Al, Cr, Co, Cu, Ga, Fe, Pb, Pd, Pt, or Ti, although additional metal species which are constituents of metal-organic compounds are known to those skilled in the art and are equally applicable. Non-limiting examples of metal-organic compounds include N-methyl Aluminum, Chromium Acetate, Chromium Ethylhexonate, Chromium Alkanedionates such as Chromium (III) 2,4-Pentanedionate and Chromium (III) 1,1,1-Trifluoro-2,4-Pentanedionate, Chromium Methoxypropoxide, Cobalt Acetate, Cobalt Alkanedionates such as Cobalt (II) 2,4-Pentanedionate and Cobalt (III) 2,2,6,6-Tetramethyl-3,5-Heptanedionate, Cobalt Carbonyls, Copper Acetate, Copper Ethoxide, Copper Dimethylaminoethoxide, Copper Formate, Copper Methoxide, Copper Alkanedionates, Copper Methacrylate, Copper fluoromethanesulfonates, Copper fluoroacetates, Diethylgallium chloride, Gallium Ethoxide, Gallium Isopropoxide, Gallium Alkanedionates, Gallium Triiodide, Trimethyl Gallium, Gallium Trishexamethydisilazide, Alanes, bisdimethylsilyl ferrocene, iron acetate, iron benzoylactonate, iron citrate, iron ethoxide, lead chloride, lead acetate, palladium trifluoroacetate, Platinum vinyl compounds, dimethylplatinum cyclooctadiene complexes, Allyltrimethyltin, acryloxytriphenyltin, allyltriphenyltin, biscyclopenadienyl titanium chloride, titanium chloride THF complex, titanium chloride trisisopropoxide, titanium tetrachloride, titanium tetrabromide, titanium tetraiodide, and in general metal acetates, metal chlorides, metal acrylates, metal ethoxides, metal butoxides, metal isoproproxides, metal methoxides, metal Alkanedionates, metal methoxyethoxides, metal formates, metal carbonyls, and metal trifluoroacetates.

In further embodiments, the precursors include metal-salts. Non-limiting examples of metal-salts include metal acetates, metal acrylates, metal methacrylates, metal formates, metal trifluoroacetates, metal trifluoromethanesulfonates, and metal neodecanonates. Additional metal-salts are known to those skilled in the art and are equally applicable as precursors. Metal-salt compounds are used with a solvent-assisted process to deposit the nanoparticles into the microporosity, nanoporosity, or free volume of the substrate 200. The solvent allows the metal-salt to be dissolved and transfer into the microporosity, nanoporosity, or free volume of the substrate 200, and upon removal of the solvent, to form into a nanoparticle.

In still further embodiments, the precursors include small organic molecules, ionic liquids, polymers, and monomers. Small organic molecules, for example, carboxylic acids such as decanedioic acid and perfluorodecanedioic acid, can be used to facilitate bonding between different layers and also can act as a passivation layer to prevent reaction between different layers. Non-limiting exemplary precursor polymers include polyurethane, polyvinyl, polyester, and monomers of these polymers including urethane, vinyl, acrylics, and esters. Non-limiting exemplary ionic liquid precursors include 1-Ethyl-3-methylimidazolium paired with dicyanamide or 1-butyl-3-methylimidazolium with hexafluorophosphate, however many other combinations are available. A factor in precursor selection is that, from a processing perspective, the precursor is compatible with the substrate 200 with regards to temperature and pressure.

Once absorbed, the precursor can be decomposed through a variety of techniques including, but not limited to, thermal, chemical, and electromagnetic radiation. In embodiments where the precursors are thermally decomposed, the decomposition of the precursor generally occurs at approximately 30° C. to approximately 300° C. In a further embodiment, the decomposition of the precursor occurs at approximately 100° C. to approximately 200° C. Additionally, in embodiments where the precursors are chemically decomposed, the decomposition of the precursor generally occurs by reacting the precursor with a second chemical species such as oxygen, water, methanol or isopropanol. For example, these chemicals can react with the deposited nanoparticles via oxidation, hydrolysis or alcoholysis reactions to convert the precursor into oxides. Other chemicals such as a reducing gas, for example hydrogen, hydrogen sulfide, carbon monoxide or methane, may be used to reduce the metal precursor into elemental metals. Further chemical species are suitable for chemically decomposing the precursor and are only limited by compatibility with the substrate 200 material. Combinations of individual steps to introduce more than one chemical species to chemically decompose the precursor can also be used to produce specific metal or metal oxide.

Upon decomposition, inorganic portions of the precursor seek nucleation sites where the inorganic portions of the precursor gather to form a nanoparticle core 10 in the substrate 200. Nucleation sites are locations within the substrate 200 that possess higher free energy than the surrounding substrate material. These can be surfaces of relatively greater surface area or curvature. Examples of these locations are sites such as phase boundaries, defects within the substrate 200, or sites where impurities are present. The higher free energy of the nucleation site lowers the free energy barrier for the nucleation process. The nucleation sites can be any of various locations including, but not limited to, inside polymer free volume domains in a polymer matrix, inside micropores or nanopores in a metal-organic framework, inside micropores in a microporous structure, inside nanopores in a nanoporous structure, around impurities in a polymer matrix, a metal-organic framework, a microporous structure, or a nanoporous structure, around specific locations on a polymer chain, or around an existing nanoparticle core 10 to form a shell layer 20, 30, 40.

In various embodiments, the nanoparticle cores 10 and core-shell nanoparticles 300 are formed in a polymer substrate 200 via thermal decomposition. A polymer substrate 200 is evacuated in a vacuum chamber in the range of approximately 1 torr to approximately 1 millitorr to evacuate the microporosity, nanoporosity, or free volume of the substrate 200 and remove any residual moisture or solvents. Subsequently, a precursor, such as a metal organic, is added to the vacuum chamber and a vacuum level in the range of 1 torr to 1 millitorr is applied. Finally, the vacuum chamber with the polymer substrate 200 and precursor disposed therein is heated to a temperature in the range of approximately 30° C. to approximately 300° C. to decompose the precursor and form a nanoparticle core 10 of the polymer or metal species of the selected metal organic compound or metal-salt.

Figure 4:
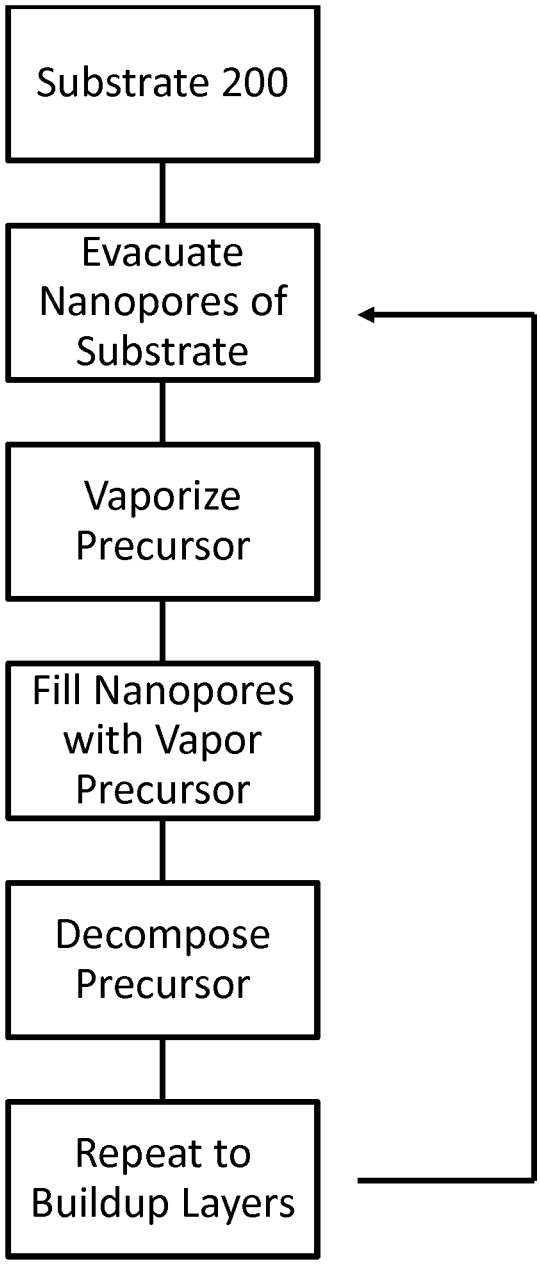
FIG. 4 is a flowchart of a method of forming a composite according to yet another embodiment of the present disclosure.

Referring to FIG. 4, in an embodiment, to form copper nanoparticles in a substrate 200, such as thermoplastic fluoropolymers, polyvinyl, polystyrene, polyethylene, nylon, polyester, acrylics, polypropylene, epoxies, polyamides, polyurethanes, zeolites, and metal organic frame works, the precursor copper ethoxide can be used. For example, a substrate 200, such as polytetrafluoroethylene, is placed in a vacuum chamber to evacuate the microporosity, nanoporosity, or free volume and remove any residual moisture or solvents. The copper ethoxide is subsequently introduced into the vacuum chamber along with the substrate 200 in a manner preserving the chemical integrity of the copper ethoxide. Copper ethoxide is moisture sensitive, thus the copper ethoxide needs to be kept in an inert atmosphere at all times during the transfer from the storage container to the equipment where the process of in-situ nano-manufacturing is carried out. The vacuum chamber is evacuated at approximately room temperature to reduce the pressure to under approximately 1 torr and sublime the copper ethoxide upon the addition of heat. Once vacuum is achieved under approximately 1 torr, heat is applied to reach a temperature of approximately 100° C. which effects sublimation of the copper ethoxide. The sublimation of the copper ethoxide leads to vapor diffusion into the substrate 200. Finally additional heat is applied to the vacuum chamber to reach the temperature of approximately 200° C. which is sufficient to cause thermal decomposition of the copper ethoxide vapor. Upon copper ethoxide vapor decomposition, the copper components nucleate in the substrate 200 to form a nanoparticle core 10. The remaining organic vapors after the copper components nucleate in the substrate 200 to form a nanoparticle core 10 are removed by evacuation under vacuum. The same process can be repeated using copper ethoxide to form an additional copper shell layer 20, 30, 40 around the original core 10. Alternatively, the metal organic precursor can be changed to create an alternate material shell layer around the original core 10. A non-limiting alternative would be titanium chloride to form a titanium oxide shell 20, 30, 40 around the copper core 10.

In an embodiment, the core-shell nanoparticles 300 are uniformly dispersed throughout the substrate 200.

The size of the core-shell nanoparticles 300 can be adjusted based on the layer-by-layer processing methods. Initial particle sizes for the core 10 have been visualized as small as 1 nm, however lower limits are believed obtainable. Without wishing to be bound by theory, it is believed possible to have cores 10 of core-shell nanoparticles 300 at the angstrom level encompassing just a few atoms of material condensed together. After formation of the core 10, subsequent processing leverages the cores 10 as nucleation points where more atoms of decomposed precursors are deposited which results in formation of a shell layer 20, 30, 40 and a size increase from the initial core 10. This approach can grow core-shell nanoparticles 300 in a layer-by-layer fashion upwards of 100 nm and into the transition between micro and nanoscale. In an embodiment, the core-shell nanoparticles 300 have a mean average diameter of less than approximately 30 nm. In a further embodiment, the core-shell nanoparticles 300 have a mean average diameter of approximately 30 nm to approximately 100 nm. In still a further embodiment the core-shell nanoparticles 300 have a mean average diameter of approximately 5 nm to approximately 50 nm. In an embodiment, these core-shell nanoparticles 300 are uniformly dispersed in the substrate 200.

Without wishing to be bound by theory, achieving nanoparticles having a mean average diameter of less than approximately 30 nm has traditionally been challenging, because alternative processing routes to make nanoparticles have difficulty controlling size as there is not a framework that restricts how large a particle can become. The unconstrained nature of the formation of the nanoparticles in alternate processes allows the nanoparticles to grow beyond a 30 nm threshold. Formation of core-shell nanoparticles 300 in the substrate 200 provides a constrained volume for formation in the microporosity, nanoporosity, or free volume which prevents expansion of the core-shell nanoparticle 300 beyond the constrained volume.

In an embodiment, a mean average diameter of less than approximately 30 nm of the core-shell nanoparticle 300 is controlled by limiting the amount of precursor being mixed with the substrate 200 in the reaction chamber. The nanoparticles can only continue to grow when the precursor is available to a nucleated site. Thus, the size of the nanoparticles can be controlled by carefully adjusting the amount of precursor material being introduced into the reaction chamber. Additionally, the nanoparticles created in the substrate 200 are confined to the nucleation sites and are not free to move around, thus the nanoparticles are prevented from growing in size when they are limited by diffusional constraints, free volume boundaries, and the competition between new particle nucleation and particle growth favoring nucleation. Alternative processes are carried out from bottom up approaches in gas or liquid media via precipitation, crystallization, or condensation, or from top down size reduction via ablation or milling techniques. These alternative processes do not have constraints due to physical substrate 200 matrix boundaries and favored nucleation kinetics that limit sizes to 30 nm. These alternative routes can achieve particle sizes less than 100 nm, however the distribution of particles is broad and the mean particle size is usually greater than 30 nm.

Nanocomposite 100 additives comprising core-shell nanoparticles 300 in a substrate 200 can be used to provide various modifications and enhancements to a range of energetic materials. Energetic materials include solid propellants, liquid propellants, fuels, primary and secondary explosives, boosters, primers, ignition materials and pyrotechnics. Characteristics expected to be modified using the nanocomposite 100 additive(s) include burning rate, ignition delay, ignitability, combustion efficiency, detonation velocity and energy density.

Differential scanning calorimetry (DSC) data has shown that aluminum nanoparticles formed using a vapor-phase in situ nanocomposite process in a cellulose acetate butyrate (CAB) substrate 200 provides a significant increase in the combustion efficiency of the host cellulose acetate butyrate (CAB) binder system. At relatively low loadings, approximately 1 wt % to approximately 10 wt % aluminum nanoparticles, continued incremental improvement in measured combustion enthalpy, well beyond the theoretical contribution of aluminum alone has been observed as shown in the table below. Without wishing to be bound by theory, it is believed that the aluminum nanoparticles are effecting more complete combustion of the polymer binder. Similar performance enhancements have been demonstrated with other binder systems, including the use of the CAB/AI nanocomposite additive as a mix-in component in hydroxyl-terminated polybutadiene (HTPB). Using the nanocomposite 100 as an additive in an HTPB binder system showed that the inherent combustion efficiency improvements demonstrated in the nanocomposite 100 translated to a secondary system as well. A small addition of aluminum nanoparticles in the form of nanocomposite 100 additive had a significant impact on the combustion of HTPB, even though the aluminum was not directly formed in the HTPB.

Core-shell nanoparticles 300 embedded in a polymer matrix substrate 200 are useful in producing reduced sensitivity energetic compositions. Reduced sensitivity energetic compositions include many common forms of energetic compositions with added benefits of reduced shock sensitivity enabling a reduction in unwanted detonation of a composition due to physical shock events. Reduced sensitivity energetic compositions have enhanced capability to only respond to an intended trigger specific detonation. In an embodiment, the core-shell nanoparticle 300 layer-by-layer fabrication approach can be leveraged to form nanoparticles of thermite fuel, barrier layer, and oxidizer systems to form a core-shell nanothermite. The barrier layer may comprise, for example, organic molecules, polymers, metal, and inorganic oxides. The alternating layers of metal fuel and metal-oxide oxidizer can be in intimate contact or separated by a barrier layer to provide additional insensitivity. The specific architecture of the core-shell nanoparticles 300 configured as thermite can vary based on the descriptions of FIG. 1 including repeated alternating layers of metal fuel and metal-oxide oxidizer with or without barrier layers. In an embodiment, the metal fuel is elemental aluminum and the metal-oxide is iron oxide. Further, non-limiting examples of metal fuel include boron, lithium, and beryllium.

The measured effect of the nanocomposite 100 additive has a variety of other potential applications in energetic material formulations, including increasing the energy density of fuels and propellants, reducing ignition delay time in liquid fuels, providing increased ignitability of solid propellants while reducing their sensitivity, providing secondary combustion characteristics in explosives, and controlling burning rate in propellants.

In an embodiment, nanocomposite 100 additives comprising aluminum nanoparticles in a polymer matrix can be used to enhance combustion efficiency and energy output of liquid turbine and rocket fuels, and may also reduce ignition times. The polymer matrix may comprise, for example, polyimides, polyamides, polyalkylenes, modified cellulose derivatives, starch, polyesters, polymethacrylates, polyacrylates, polyvinyl alcohol, polyvinyl acetate, polybutadiene, polyvinylpyrrolidone, polyacrylamide, poly(alkylene oxides), poly(vinyl chloride), polysiloxanes, or fluoropolymers, such as polyfluoroalkylenes, poly(fluoroalkyl vinyl ethers), fluorochloropolymers and perfluoropolymers. Additionally, the aluminum may form the core or may alternatively form one or more shell layers. The non-aluminum layers comprise either a polymer passivation agent such as a perfluorinated carboxylic acid or an oxidizer agent such as iron oxide. The polymer matrix acts as a dispersant in liquid fuels thus allowing dissolution and dispersion of nanoparticles throughout the liquid fuel.

In another embodiment, core-shell nanoparticles 300 may be utilized to control the burning rate of a solid rocket propellant. The control of the burning rate of a solid rocket propellant is correlated with the efficient use of the stored energy in a solid propellant propulsion system. Increasing the burning rate of a solid rocket propellant achieves higher thrust and missile burnout velocity whereas decreasing the burning rate allows for sustaining a longer burn time and range. Motor designers seek the means to modify the solid rocket propellant burning rate to meet various mission parameters. A nanocomposite 100 additive of aluminum core iron oxide shell particles in a host polymer such as cellulose derivatives, polybutadiene, glycidyl azide polymer (GAP) or poly(3,3-bis-azidomethyl oxetane) (Poly-BAMPO), added to a solid propellant binder system provides the motor designer with tailorability and control of propellant burning rate. The effects of these aluminum and iron oxide core-shell nanoparticles 300 can be tuned based on a variety of factors including loading rate, particle chemistry, core and shell order, and overall particle size. The specific effects include causing a propellant to ignite uniformly at a reduced temperature, causing a propellant to ignite uniformly at an elevated temperature, increased specific impulse, or plateau the burn rate of a propellant as opposed to typical accelerations with unmodified propellant compositions.

In an embodiment, a nanocomposite 100 additive of metal nanoparticles in a polymer substrate 200 of polyimides, polyamides, polyalkylenes, modified cellulose derivatives, starch, polyesters, polymethacrylates, polyacrylates, polyvinyl alcohol, polyvinyl acetate, polyvinylpyrrolidone, polyacrylamide, poly(alkylene oxides), poly(vinyl chloride), polysiloxanes, fluoropolymers such as polyfluoroalkylenes, poly (fluoroalkyl vinyl ethers), fluorochloropolymers and perfluoropolymers, or ultra high-energy energetic polymer binders, such as glycidyl azide polymer (GAP) or poly(3,3-bis-azidomethyl oxetane) (Poly-BAMPO) may be added to a solid propellant binder system to offer motor designers a means of increasing the energy-density of propellant systems. Examples of propellant systems include the products produced by mixing polymer binders, such as hydroxyl-terminated polybutadiene (HTPB), polybutadiene acrylic acid acrylonitrile prepolymer (PBAN), paraffin wax or energetic polymer binders, such as glycidyl azide polymer (GAP) or poly(3,3-bis-azidomethyl oxetane) (Poly-BAMPO); curing additives, such as 4,4'methylene diphenyl isocyanate (MDI);

burn rate catalysts, such as ferric oxide, cobalt oxide, manganese oxide, chromium oxide, copper chromite, ferrocene-based or carborane-based catalysts; together with oxidizers such as ammonium perchlorate (APCP), ammonium nitrate, or potassium nitrate; and the metal fuel, such as aluminum, lithium or beryllium metal particles. Propellant formulators typically add metal fuels and other high density ingredients to propellants to increase energy density, but are often limited by processing restrictions. A nanocomposite 100 additive provides increased energy density to achieve more complete combustion of the binder in addition to the positive enthalpic contribution of the metal particles, while not adversely impacting propellant processing. In an embodiment, the specific metal nanoparticle for addition to the solid propellant binder system is a core-shell nanoparticle 300 comprising aluminum and iron oxide. Each propellant formulation differs on the desired ratio of nanoparticles needed; however it is typical to find propellant formulations in the range of 0.1 to 15% by weight of the nanocomposite 100. The aluminum to iron oxide molar ratio in the core-shell nanoparticles 300 ranges from approximately 5:1 to approximately 1:5 in various embodiments. In specific embodiments, the aluminum to iron (III) oxide molar ratio in the core-shell nanoparticles 300 is approximately 2:1.

In an embodiment, nanocomposite 100 additives of reactive metal or thermite may be added to the initial burning layer of a cured propellant grain in a solid propellant. For purposes of this disclosure, the initial burning layer is the first surface of the cured solid propellant that will be exposed to the ignition charge. Reduced sensitivity solid propellants have been developed to self-extinguish in low pressure environments. While this self-extinguishing characteristic is desirable from a resistance to hazards perspective, it typically means that the propellant is difficult to ignite, requiring motor and/or igniter redesign efforts to ensure proper ignition in an operational environment. Using the nanocomposite 100 additives of reactive metal or thermite in the initial burning layer of the cured propellant grain provides the augmentation of propellant ignition and flame spreading needed to reliably ignite the reduced sensitivity solid propellants, while not affecting the sensitivity of the bulk propellant.

In various embodiments, the reactive metal added to the initial burning layer of a cured propellant grain in a solid propellant to form a nanocomposite 100 is aluminum, boron, lithium, or beryllium. In another embodiment metal hydrides are added to the initial burning layer of a cured propellant grain in a solid propellant to form a nanocomposite 100.

In an embodiment, metal, metal oxides, thermite, or metal hydrides are added to the initial burning layer of a cured propellant grain in a solid propellant to form a nanocomposite 100 having up to approximately 30 wt % of the metal, thermite, or metal hydride. In another embodiment the nanocomposite 100 has up to approximately 15 wt % metal, metal oxides, thermite, or metal hydride.

In various embodiments, the cured propellant grains include the cured or cross-linked mixture made from polymer binders, such as hydroxyl-terminated polybutadiene (HTPB), polybutadiene acrylic acid acrylonitrile prepolymer (PBAN), paraffin wax, or energetic polymer binders, such as glycidyl azide polymer (GAP) or poly(3,3-bis-azidomethyl oxetane) (Poly-BAMPO); curing additives, such as 4,4'methylene diphenyl isocyanate (MDI); burn rate catalysts, such as ferric oxide, cobalt oxide, manganese oxide, chromium oxide, copper chromite, ferrocene-based or carborane-based catalysts; and any additional high-energy fuel additives such as aluminum metal particles.

In an embodiment, nanocomposite 100 additives are used in primary explosive formulations to enhance performance by increasing detonation energy and detonation velocity, as well as enhancing blast, without increasing sensitivity to inadvertent initiation. In an embodiment, core-shell nanoparticles 300 with an aluminum core 10 and an iron oxide shell 20, 30, 40 are formed in a cellulose acetate butyrate (CAB) substrate 200 to form a nanocomposite 100 additive for use in an explosive formulation.

In an embodiment, a nanocomposite 100 additive of core-shell nanoparticles having an aluminum core 10 and iron oxide particles and at least one iron oxide shell layer 20, 30, 40 formed in a host polymer substrate 200 are added to a solid fuel grain of a hybrid rocket. A hybrid rocket being a rocket with a rocket motor which uses propellants in two different states of matter—one solid and the other either gas or liquid. Non-limiting examples of gaseous or liquid propellant include gaseous or liquid oxygen and nitrous oxide. Hybrid rocket motor solid fuel grains typically suffer from low regression rates (rate at which the solid phase recedes), which prevents hybrid rockets from competing with solid rockets in many high performance applications. The nanocomposite 100 additive of aluminum or iron oxide core-shell nanoparticles 300 in a host polymer substrate 200, added to a solid fuel grain provides the hybrid motor designer with tailorability and control of fuel grain burning rates and the ability to increase regression rates of the solid fuel.

In various embodiments, the host polymer substrate 200 of the nanocomposite 100 added to a solid fuel grain of a hybrid rocket is a polyimide, polyamide, polyalkylene, modified cellulose derivative, starch, polyester, polymethacrylate, polyacrylate, polyvinyl alcohol, polyvinyl acetate, polyvinylpyrrolidone, polyacrylamide, poly(alkylene oxide), poly (vinyl chloride), hydroxyl-terminated polybutadiene (HTPB), polysiloxane, fluoropolymer such as polyfluoroalkylene, poly(fluoroalkyl vinyl ether), fluorochloropolymer or perfluoropolymer.

In various embodiments, the solid fuel grain is a composite made from a polymer binder, such as hydroxyl-terminated polybutadiene (HTPB), polybutadiene acrylic acid acrylonitrile prepolymer (PBAN), paraffin wax; or an energetic polymer binder, such as glycidyl azide polymer (GAP) or poly(3,3-bis-azidomethyl oxetane) (Poly-BAMPO); a curing additive, such as 4,4'methylene diphenyl isocyanate (MDI); a burn rate catalyst, such as ferric oxide, cobalt oxide, manganese oxide, chromium oxide, copper chromite, ferrocene-based or carborane-based catalysts; and any additional high-energy fuel additive such as aluminum metal particles.

The addition of fluorine compounds either as oxidizers, plasticizers, or binders increases the specific impulse and energy density of solid propellants. The increased density and the overall energy release exhibited by fluorine-containing compounds are typically accompanied by increased propellant sensitivity. In an embodiment, a nanocomposite 100 additive, acting as a reactive catalyst, enhances combustion of the fluoropolymer, and allows reduction of other high energy, sensitive propellant ingredients. This approach simultaneously keeps propellant sensitivity low while increasing the overall enthalpic output of the propellant. In an embodiment, aluminum nanoparticles are added to the fluoropolymer at a loading of approximately 2% to approximately 5% by weight.

In an embodiment, mechanically mixed nanocomposite 100 additives containing core-shell nanoparticles 300 with aluminum cores 10 and iron oxide shell layers 20, 30, 40 are used to provide a secondary reaction, or enhanced blast mechanism in explosive fills. Such a mixture may also be used to increase reactivity and brisance of ignition materials.

A concern for rocket motor designers and propellant formulators is the migration of water through a solid rocket motor (SRM) liner into a propellant grain as well as migration of chemical species from the propellant grain through the liner system. Both of these occurrences can lead to propellant damage and catastrophic effects upon propellant ignition. In an embodiment, nanocomposite 100 additives are used to block migration of water and chemical species through the liner. Examples of core-shell nanoparticles 300 that are suitable for blocking the migration of water or propellant chemicals are core-shell nanoparticles 300 having an inert oxide shell layer 20, 30, 40, such as silica, alumina, and chromium oxide; and a chemical resistant metal core 10, such as titanium or palladium. The migration of water or propellant chemical species in the vapor phase through the liner occurs via the channels created by the microporosity, nanoporosity, or free volume of the elastomeric liner's matrix. The generation of solid phase nanoparticles by the in-situ nanomanufacturing process within these microporous, nanoporous structure, or inside the free volume can effectively block these channels, thus reducing the permeability of the liner to water or propellant chemicals.

Multipulse solid rocket motors are used for energy management and performance optimization of advanced tactical missile systems with stressing mission requirements. Elastomeric thermal barriers have been used to provide protection of each discrete pulse as the previous pulse burns. Often, these barriers are the source of motor failures, either through mechanical failure such as tearing or plugging of the nozzle during their ejection. In an embodiment, metal or thermite nanocomposite 100 additives are added to the elastomeric thermal barrier to enhance tear resistance and combustibility.

Challenged by the need for higher propellant mass fraction, rocket motor designers are increasingly turning to reinforced polymer matrix composites for their significantly higher strength-to-weight ratio compared to traditional steel motor cases. This reduced inert weight comes with several challenges, including requirements for a moisture barrier, conductivity, and thermal protection. In an embodiment, nanocomposite 100 additives are added to the reinforced polymer matrix composite to provide and enhance the moisture barrier, conductivity, and thermal protection properties of composite motor cases. Examples of core-shell nanoparticles 300 suitable for improving moisture barrier properties include core-shell nanoparticles 300 composed of an inert oxide, such as silica, alumina, chromium oxide, or moisture resistant metal, such as chromium, nickel, titanium, niobium and palladium. Examples of core-shell nanoparticles 300 suitable for improving conductivity include core-shell nanoparticles 300 having an electrically conductive shell layer 20, 30, 40, such as chromium, nickel; and a core 10 made of silica, alumina, chromium oxide, titanium, tungsten, or molybdenum. Examples of core-shell nanoparticles 300 suitable for improving thermal protection include core-shell nanoparticles 300 having an inert oxide, such as silica, alumina, chromium oxide, or heat resistant metal such as titanium, molybdenum, niobium, rhenium, tungsten and tantalum. In selecting between materials that have similar properties (e.g. water resistance or thermal resistance), the choice of whether one is used as a core 10 or shell layer 20, 30, 40 is dependent on material cost and other properties such as density, or specific range of conductivity required.

Missile propulsion systems often use thrust vector control (TVC) to provide steering when aerodynamic control is unavailable or insufficient. Jet vane TVC systems, in which metallic vanes move into the rocket exhaust plume to deflect the flow, suffer from high rates of erosion in this harsh environment. In an embodiment, nanocomposite 100 additives, sprayed onto the jet vane surface, act as a sacrificial layer, thereby providing needed, short-duration protection and increasing the operational life of the vane material. In an embodiment a titanium dioxide or aluminum oxide composition, either as core 10 or shell layer 20, 30, 40, provides enhanced durability as a sacrificial layer. The titanium dioxide and aluminum oxide chemistries are inert when shed into the environment and provide the necessary durability. The specific chemistry of the core 10 is selected based on cost factors while the shell layer 20, 30, 40 is selected for durability.

Gun propellant formulators have historically rejected the use of metal fuels, such as aluminum, to increase the delivered energy of these systems due to concerns about gun barrel erosion. In an embodiment, nanocomposite 100 additives containing metal or metal oxide particles added to the gun propellant offer the potential to realize significant gains in delivered energy in gun propellants using polymeric binder systems, such as cellulose acetate butyrate (CAB), or thermoplastic elastomers (TPEs), without the adverse effects on gun barrel wear typically seen with micron-scale aluminum powder. Smaller metal particles will completely burn quickly and at lower temperatures, resulting in gaseous expansion to propel the bullet and lower temperature gas reactions on the gun barrel, comparing with micron-sized metal powder, which may not burn as quickly, reaches higher temperatures and partly remains as an abrasive to the gun barrel during the burning process to propel the bullet out of the gun barrel. Example gun propellants include conventional gun propellant described in U.S. Army Propellant manual No. AMCP-706-150, published February 1965 based upon nitrocellulose, nitroglycerin (NG), and nitroguanidine (NQ), or a mixture of nitrocellulose, nitroglycerin, and diethyleneglycol dinitrate; cyclotrimethylenetrinitramine (RDX) nitrocellulose-based propellant; or ultra high-energy gun propellant formulations based upon energetic polymer binders, such as glycidyl azide polymer (GAP) or poly(3,3-bis-azidomethyl oxetane) (Poly-BAMPO)). In an embodiment, nanocomposite 100 additive comprises core-shell nanoparticles 300 with an aluminum or boron core 10 and an alumina shell layer 20, 30, 40.

Case-bonded solid propellant rocket motors employ an elastomeric internal insulation to manage heat transfer into and out of the rocket motor. In an embodiment, nanocomposite 100 additives are added to the internal insulation to improve the mechanical properties of elastomers used for rocket motor insulation, to provide increased tear resistance, and promote greater structural integrity in the insulation's char layer during motor operation. The addition of hard core-shell nanoparticles 300 such as core-shell aluminum/alumina particles in a soft matrix provide a crack pinning and/or crack deflection mechanisms to increase tear resistance. In addition, the addition of nanoparticles of greater modulus increases the mechanical properties, such as elastic modulus and ultimate strength, of the elastomer matrix by the rule of mixture. A non-limiting example of the elastomer insulation includes polyurethane made with hydroxyl-terminated polybutadiene and 4,4'methylene diphenyl isocyanate (MDI). In an embodiment, the nanocomposite 100 additive comprises core-shell nanoparticles 300 having an aluminum core 10 and an alumina shell layer 20, 30, 40.

In an embodiment, nanocomposite 100 additives are used in shape memory polymer (SMP) fasteners to provide enhanced separation of missile components such as wiring harness covers during missile stage separation. Nanoparticles, such as nano-sized iron or ferrite (iron II, III oxide) that possess ferromagnetic properties are preferred. In an embodiment, the core-shell nanoparticles 300 have an elemental iron core 10 with a ferrite shell layer 20, 30, 40. The incorporation of such core-shell nanoparticles 300 enable the use of inductive heating to activate the shape memory transition of the shape memory polymer nanocomposite 100, resulting in lowering of the SMP fastener's modulus to allow disengagement of the fasteners.

While many embodiments are described with specific reference to missiles and rockets, it would be understood by one skilled in the art that nanocomposite 100 additives are applicable to a broader range of applications. A non-exhaustive listing of other applications of the composite 100 include electrolyte membranes, anti-counterfeit technology, transparent armor, capacitors, photovoltaics, photocatalytic material, ceramic nanopowders, polymer membrane technology, and biodegradable electronics.

While throughout this disclosure reference is made to shell layers 20, 30, 40 and FIG. 2 shows 3 distinct shell layers, it is imagined and within the scope of this disclosure to have 10s, 100s, or even 1000s of shell layers. Illustration and discussion of 3 shell layers is merely for simplicity.

It is also noted that recitations herein of "at least one" component, element, etc., should not be used to create an inference that the alternative use of the articles "a" or "an" should be limited to a single component, element, etc.

It is noted that terms like "preferably," "commonly," and "typically," when utilized herein, are not utilized to limit the scope of the claimed invention or to imply that certain features are critical, essential, or even important to the structure or function of the claimed invention. Rather, these terms are merely intended to identify particular aspects of an embodiment of the present disclosure or to emphasize alternative or additional features that may or may not be utilized in a particular embodiment of the present disclosure.

For the purposes of describing and defining the present invention it is noted that the terms "substantially" and "approximately" are utilized herein to represent the inherent degree of uncertainty that may be attributed to any quantitative comparison, value, measurement, or other representation. The terms "substantially" and "approximately" are also utilized herein to represent the degree by which a quantitative representation may vary from a stated reference without resulting in a change in the basic function of the subject matter at issue.

Having described the subject matter of the present disclosure in detail and by reference to specific embodiments thereof, it is noted that the various details disclosed herein should not be taken to imply that these details relate to elements that are essential components of the various embodiments described herein. Further, it will be apparent that modifications and variations are possible without departing from the scope of the invention defined in the appended claims. More specifically, although some aspects of the present disclosure are identified herein as preferred or particularly advantageous, it is contemplated that the present disclosure is not necessarily limited to these aspects.

It is noted that one or more of the following claims utilize the term "wherein" as a transitional phrase. For the purposes of defining the present invention, it is noted that this term is introduced in the claims as an open-ended transitional phrase that is used to introduce a recitation of a series of characteristics of the structure and should be interpreted in like manner as the more commonly used open-ended preamble term "comprising."

What is claimed is:

1. A method of forming a composite, the method comprising:

combining a first precursor and a substrate via at least one of diffusion, absorption, and adsorption;

forming a nanoparticle core through decomposition of the first precursor and nucleation of a decomposition product of the first precursor; and forming a shell layer of at least a second material through at least one of diffusion, absorption, or adsorption of at least a second precursor followed by decomposition, and nucleation of at least one shell layer on the nanoparticle core to form a core-shell nanoparticle in the substrate;

wherein the substrate has at least one of microporosity, nanoporosity, or free volume, and the first precursor and the second precursor are decomposed in-situ to form the nanoparticle core and shell layers.

2. The method of forming a composite of claim 1, wherein the first precursor or second precursor is a metal-organic compound.

3. The method of forming a composite of claim 1, wherein the first precursor or second precursor is a metal-salt.

4. The method of forming a composite of claim 1, wherein the first precursor or second precursor is thermally decomposed at approximately 30° C. to approximately 300° C.

5. The method of forming a composite of claim 1, wherein the first precursor or second precursor is chemically decomposed.

6. The method of forming a composite of claim 1, wherein the composite is a thermite composition comprising a metal fuel and a metal-oxide oxidizer.

7. The method of forming a composite of claim 1, the method further comprising combining the core-shell nanoparticles and the substrate with a solid propellant binder hydroxyl terminated polybutadiene to form a composite configured for solid rocket propellant burning rate modification, wherein the core-shell nanoparticles comprise an aluminum core and at least one iron oxide shell layer and the substrate is a polymer.

8. The method of forming a composite of claim 1, wherein the core-shell nanoparticles comprise aluminum, the substrate is a polymer matrix, and the composite is configured for liquid fuel combustion enhancement.

9. The method of forming a composite of claim 1, wherein the method further comprises combining the core-shell nanoparticles with the initial burning layer of a cured propellant grain comprising:

at least one of hydroxyl-terminated polybutadiene (HTPB), polybutadiene acrylic acid acrylonitrile prepolymer (PBAN), paraffin wax, glycidyl azide polymer (GAP) and poly(3,3-bis-azidomethyl oxetane) (Poly-BAMPO);

a curing additive; and at least one of ferric oxide, cobalt oxide, manganese oxide, chromium oxide, copper chromite, a ferrocene-based catalyst, and a carborane-based catalyst, wherein the core-shell nanoparticles comprise reactive metal or thermite and are configured to provide augmentation of propellant ignition and flame spreading.

* * * * *